US011440028B2

(12) United States Patent
Bayrakci

(10) Patent No.: US 11,440,028 B2
(45) Date of Patent: Sep. 13, 2022

(54) UNIFLOW CYCLONE SEPARATOR

(71) Applicant: Tayyar Yuecel Bayrakci, Munich (DE)

(72) Inventor: Tayyar Yuecel Bayrakci, Munich (DE)

( * ) Notice: Subject to any disclaimer, the term of this patent is extended or adjusted under 35 U.S.C. 154(b) by 297 days.

(21) Appl. No.: 16/636,360

(22) PCT Filed: Aug. 3, 2018

(86) PCT No.: PCT/EP2018/071193
§ 371 (c)(1),
(2) Date: Feb. 4, 2020

(87) PCT Pub. No.: WO2019/025617
PCT Pub. Date: Feb. 7, 2019

(65) Prior Publication Data

US 2020/0164388 A1 May 28, 2020

(30) Foreign Application Priority Data

Aug. 4, 2017 (DE) ..... 10 2017 213 608.1

(51) Int. Cl.
*B04C 3/06* (2006.01)
*B04C 3/00* (2006.01)

(52) U.S. Cl.
CPC ..... *B04C 3/06* (2013.01); *B04C 2003/003* (2013.01); *B04C 2003/006* (2013.01)

(58) Field of Classification Search
CPC ..... B04C 2003/003
See application file for complete search history.

(56) References Cited

U.S. PATENT DOCUMENTS 3,719,207 A * 3/1973 Takeda ..... F16L 55/00 366/181.5
4,051,381 A 9/1977 Trotel
6,540,917 B1 * 4/2003 Rachels ..... B04C 3/00 210/512.1
8,936,094 B2 * 1/2015 Least ..... E21B 41/0078 166/373
2002/0030011 A1 * 3/2002 Constantine ..... B04C 9/00 210/512.1

(Continued)

FOREIGN PATENT DOCUMENTS

DE 2656151 C2 6/1977
DE 10038282 A1 2/2002

(Continued)

OTHER PUBLICATIONS

International Search report based on Application No. PCT/EP2018/071193 (6 pages) dated Nov. 16, 2018 (for reference purpose only).

(Continued)

*Primary Examiner* — David C Mellon
(74) *Attorney, Agent, or Firm* — Amster, Rothstein & Ebenstein LLP

(57) ABSTRACT

The disclosure relates to an axial-flow centrifugal separator for separating particles from a dispersion, in particular a suspension, which contains the particles and a fluid, the separator including a hollow cylindrical pipe section for conducting the dispersion in a conducting direction. An inner wall of the hollow cylindrical pipe section may have an internal thread, the lead angle of which increases in the conducting direction.

10 Claims, 5 Drawing Sheets

(56) References Cited

U.S. PATENT DOCUMENTS

| | | | | |
|---|---|---|---|---|
| 2003/0115843 | A1* | 6/2003 | Haland | B01D 45/16 55/392 |
| 2004/0025481 | A1 | 2/2004 | Bugli et al. | |
| 2005/0086915 | A1 | 4/2005 | Greif et al. | |
| 2009/0065431 | A1* | 3/2009 | Bakke | B01D 17/0217 210/512.1 |
| 2012/0103423 | A1* | 5/2012 | Schook | B04C 3/06 137/1 |

FOREIGN PATENT DOCUMENTS

| | | | |
|---|---|---|---|
| EP | 0344750 | A2 | 12/1989 |
| EP | 1206310 | A1 | 5/2002 |
| EP | 1512453 | A1 | 3/2005 |
| GB | 1526509 | A | 9/1978 |
| GB | 2287895 | A | 10/1995 |
| WO | 20170036970 | A1 | 3/2017 |

OTHER PUBLICATIONS

German Office Action based on Application No. 10 2017 213 608.1 (4 pages) dated Mar. 29, 2018 (for reference purpose only).

* cited by examiner

UNIFLOW CYCLONE SEPARATOR

CROSS-REFERENCE TO RELATED APPLICATIONS

This application is a national stage entry, according to 35 U.S.C. § 371, of PCT Application No. PCT/EP2018/071193 filed on Aug. 3, 2018, which claims priority to German Application No. 10 2017 213 608.1 filed on Aug. 4, 2017, both of which are herein incorporated by reference in their entirety.

BACKGROUND

The disclosure refers to a uniflow cyclone separator for separating particles from a dispersion containing the particles and the fluid. In particular, the dispersion may be a suspension. The disclosure further refers to the use of the uniflow cyclone separator.

For separating particles from a dispersion containing the particles and the fluid, such as a gas or a liquid, a filter may be used by which the dispersion is led through a membrane. Here, the particles are disposed at the membrane which has to be exchanged after a certain amount of time in order to avoid a congestion. Alternatives are cyclone separators also referred to as cyclones or centrifugal cyclones. The cyclone separators are formed as counterflow cyclone separators, also referred to as tangential cyclone separators, or as uniflow cyclone separators, also referred to as axial separators.

In dispersion flows, the particles are exposed to influences of volume forces and fluid forces. Volume forces in a swirling flow are, for example, centrifugal forces and the gravity. Fluid forces in a swirling flow are, for example, aerodynamic forces which are caused by a radial velocity gradient. Here, a buoyancy force acts on the particles because of the gradient of the dynamic pressure. Therefore, the particles are sucked towards the faster portions of the flow.

In the counterflow cyclone separators, the dispersion is led into a vessel having a rounded side wall, such as a ton or cone, wherein it is tangentially passed in. The axis of the vessel is therefore basically vertical and perpendicular to the original moving direction of the dispersion and therefore perpendicular to the direction of the passing in of the dispersion into the vessel. Therefore, the dispersion is forced into a circular or a spiral form which is given by the wall of the vessel. Because of the, in most cases, increased weight of the particles, these are forced radially towards the outside and are decelerated by the wall. As a result, the particles conglomerate at the bottom of the vessel. In most of the cases, the fluid is derived from an outlet arranged vertically above the bottom; in most cases, the outlet is arranged above the position of the inlet of the dispersion into the vessel. Because of the vertical passing of the dispersion into the vessel, the required space is increased and an upgrade of existing devices by such a counterflow cyclone separator therefore is not possible in most of the cases. Also, the direction in which the fluid is led out of the counterflow cyclone separator may not correspond to the direction in which the dispersion is passed into the counterflow cyclone separator, wherefore further redirections of the dispersion are necessary. Additionally, a relative high pressure loss for the fluid and/or for the particle separation is caused.

BRIEF DESCRIPTION OF THE DRAWINGS

In the following, exemplary aspects of the disclosure are further explained with the aid of drawings. Elements corresponding to each other have the same reference numbers throughout the figures.

DESCRIPTION

Figure 1:
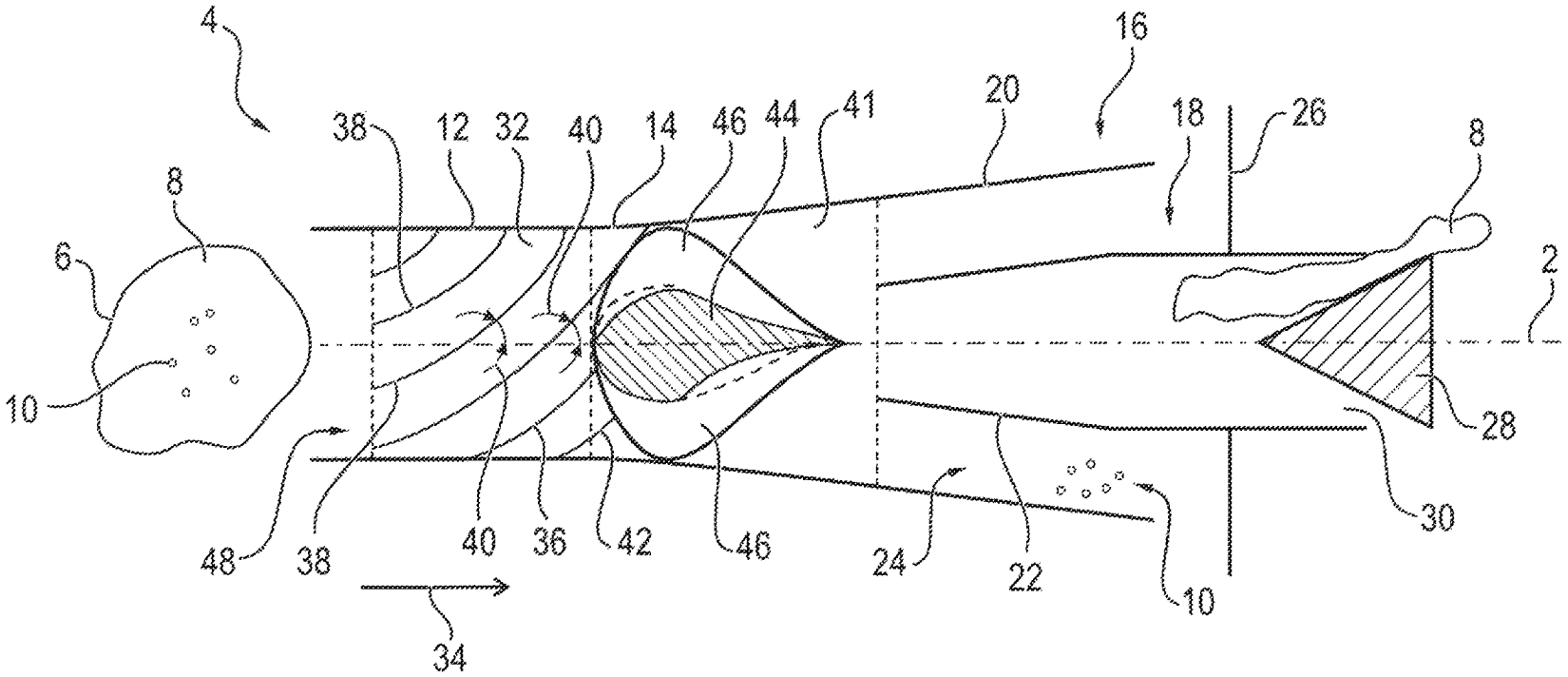
FIG. 1 schematically shows a uniflow cyclone separator having a pipe section, which has an inner wall having a female thread, and having second pipe section, in which a damming body, having guide blades being attached to it and extending radially outwardly, is arranged.

Here, uniflow cyclone separators are alternatives. In these, the dispersion is forced into a rotational movement around an axis parallel to the direction of the movement of the dispersion. In most of the cases, the generation of this movement is caused by guide blades being arranged in a pipe portion of the uniflow cyclone separator or by a secondary flow which is tangentially fed in. In this manner, a velocity in a tangential direction is imprinted into the dispersion, wherein the maximum velocity of the dispersion, its absolute amount, is basically central between a wall of the pipe and the center of the pipe. Therefore, the particles here are moved radially outwards also, whereas the fluid is basically moved to the center of the uniflow cyclone separator. However, because the maximal velocity is not at a rim of the portion of the pipe, a force acting on the particles in radial direction is decreased the more the particles move away from the area of maximal velocity, wherefore a few particles only conglomerate in the rim area.

Namely, the rotation of the dispersion leads to a formation of a Hamel-Oseen-Vortex, which basically corresponds to a rigid body vortex in the kernel area and to a potential vortex towards the pipe wall directly following radially outwardly. Depending on the vortex structure, an area of maximal absolute velocity is generated, which may be seen as a drain regarding the fluid forces, and to which the particles are moved.

Because of the construction, the uniflow cyclone separator may be subsequently integrated in existing systems. Also, the manufacturing costs of such a uniflow cyclone separator are reduced. Additionally, only a relative low pressure loss is caused, because it is not necessary to redirect the dispersion perpendicular to the moving direction. However, an efficiency of the uniflow cyclone separator and a selectivity between the particles and the fluid may be decreased. In particular, in an aspect such as a uniflow hydrocyclone, the deposition rate may be further reduced, because of the basically same density of the particles and the fluid.

It is an object of the present disclosure to provide a particularly suitable uniflow cyclone separator and a particularly suitable use of a uniflow cyclone separator, wherein an efficiency is advantageously increased.

According to the disclosure, this object is solved regarding the uniflow cyclone separator by the features described and claimed herein. Further advantageous aspects may be similarly described and claimed herein.

The uniflow cyclone separator contributes to the separation of particles from the dispersion. The dispersion may be formed by the particles and the fluid. The density of the particles and the density of the fluid may, for example, be basically the same. The ratio of the densities may be 1 or at least between 0.95 and 1.05 or between 0.99 and 1.01 or between 0.995 and 1.005. The particles may have a size, for example between 1 nm to 1 μm or, for example, larger than 1 μm. Further, the particles may have a particle size between 0.1 mm and 1 mm or larger. The particles may comprise one single substance or various substances or elements. For example, the particles are heterogeneous.

For example, the particles may be at least partially formed by sand. For example, the fluid is a gas or a liquid. For example, the fluid is incompressible and a liquid. In other words, the dispersion may be a suspension. For example, the fluid is water which may be taken out from running water or the sea. The fluid may for example be used as cooling liquid in an industrial device or as process water in mining. Alternatively, the fluid may be passed into a desalination facility, and the dispersion is seawater, in which for example particles, in particular sand, are present.

The uniflow cyclone separator is an axial separator. In other words, the uniflow cyclone separator is an axial/unidirectional centrifugal separator. The dispersion is led through the uniflow cyclone separator in the guiding direction, wherein the guiding direction may not be changed for the separation. Suitably, the guiding direction is constant. In other words, the direction in which the dispersion or at least the fluid are fed is not changed.

The uniflow cyclone separator has a pipe section, which may be formed hollow-cylindrically and contributes to the leading of the dispersion in the guiding direction. Here, the dispersion is led through the hollow-cylindric pipe section during operation. For example, the guiding direction is at least partially parallel to the axis of the hollow-cylindric pipe section. The pipe section has an inner wall, along which therefore the dispersion is led during operation. In some aspects, the hollow-cylindric pipe section has a basically circular cross-section. The hollow-cylindric pipe section may be free from further parts of the uniflow cyclone separator such that it may be passed relatively free by the dispersion. In other words, there may be no further parts within the inner wall and a hollow space is formed by the inner wall.

The inner wall of the pipe section may have a female thread. In other words, the inner wall has an indentation and/or a radially inwardly protruding extension, which extends in the form of a coil along the guiding direction. In particular, by the indentation and, respectively, the extension, a helix is formed, for example, a curve, curling around a cylindric barrel with a slope, wherein the cylinder is particularly provided by the inner wall. In other words, the female thread curls around the axis of the hollow-cylindric pipe section. In particular, the inner wall has the female thread in the guiding direction over its full length. The length of the pipe section is for example the same as the diameter of the pipe section or larger than the diameter of the pipe section, larger or the same as twice the diameter of the pipe section, or larger or the same as triple that of the pipe section. For example, the length of the pipe section is larger or the same as 10 times, 20 times, 50 times, 100 times or 150 times the diameter of the pipe section.

The female thread contributes to the swirl generation of the dispersion such that it has a velocity component tangential, e.g., perpendicular, to the guiding direction after passing the female thread. So, the female thread is the swirl generator. In other words, because of the female thread, the dispersion is forced into the rotational movement in addition to the translation movement along the guiding direction, wherein the rotational movement is perpendicular to the guiding direction. Here, the tangential velocity component is applied on the layers of the dispersion moving along the inner wall by the female thread, which is transferred to the further, interiorly positioned areas of the dispersion because of viscosity or similar. As a consequence, the dispersion has a velocity profile which is not constant.

In sum, the outer areas of the dispersion, i.e., those which are relatively close to the inner wall, in particular in the area of the extension protruding inwardly, have the largest velocity because of the female thread. This velocity corresponds to the dominating velocity, because of leading the dispersion along the guiding direction, in addition to the velocity, which is applied because of the female thread. Here, the part of the dispersion, which is basically only in the center, has the velocity component in the guiding direction only. Because of the viscosity of the dispersion, the velocity basically linearly increases from the center of the pipe section towards the inner wall such that the rotational movement of the dispersion basically corresponds to that of a solid body.

As a consequence, the particles are relatively efficiently moved radially outwardly to the inner wall of the pipe section because of the centrifugal force, in particular in conjunction with the fluid force, wherein the force acting on the particles in the radial direction increases with decreasing distance to the inner war. So, the more outward the particles are already positioned, the stronger they are moved outwardly, which leads to a relative sharp separation between the particles and the fluid in the dispersion. The particles themselves particularly move along the helix course, which is provided because of the slope of the female thread. No movable parts may be necessary for separating the particles from the dispersion, thereby reducing manufacturing costs and failure sensibility. In addition, the efficiency is increased. The particles themselves are removed from the fluid by a suitable separation chamber, which may be arranged fluid-technically after the pipe section. In particular, by the uniflow cyclone separator, an efficiency, i.e., the ratio of the fluid led out of the uniflow cyclone separator to the volume of the dispersion lead into of the uniflow cyclone separator, of up to 80% is realized, wherein a particle separation (a degree of particle separation) of up to 95% is achieved during operation.

In particular, the female thread has a notch (e.g. a nut) which is realized by the indentation (groove). In other words, the notch corresponds to the groove and the notch is formed in a helix form along the guiding direction and the inner wall is notched for forming the notch. Particularly, the female thread has an amount of such notches. Hereby, the swirl generation in the dispersion is improved. For example, the amount of notches is between two notches and 100 notches, between 4 notches ad 20 notches and, for example 12 notches, what leads to the relatively effective swirl generation, wherein the formation of vortices is particularly decreased.

Additionally, having such an amount of notches, the manufacturing costs are relatively low. For example, the notches are provided by grooves, which, for example, have a basically rectangular cross-section. However, in some aspects, the notches are rounded and the cross-section of each notch suitably is handle-shaped and/or pinna-shaped.

So, the cross-section of each notch is formed at least partially spiral-shaped, for example, logarithmically spiral-shaped, and/or curved. Consequently, the hollow-cylindric pipe section has a cross-section which may be cog wheel-shaped or saw blade-shaped. For example, the cross-section is formed in accordance with the cross-section of a free wheel. Because of the curvatures, the formation of unwished vortices is further decreased, which otherwise would lower the efficiency.

For example, the angle of slope of the female thread is constant. However, in some aspects, the angle of slope increases in the guiding direction. For example, the angle of slope starts at 0° and, for example, increases continuously such that the formation of vortices is further avoided. As a consequence, the rotation velocity of the dispersion around an axis along the guiding direction continuously increases, further increasing the efficiency. In particular, the angle of slope of the female thread may correspond to the angle of slope of the notches and, in some aspects, the angle of slope of the notches is the same, at least at the same position in the guiding direction. For example, the angle of slope is the angle between the female thread, in particular the notch, and the guiding direction. For example, the angle of slope is between 15° and 60° and increases, for example, between 15° and 60°, either continuously or exponentially. As a consequence, after passing the pipe section, in the area of the inner wall, the dispersion basically has the same velocity component in the guiding direction as in the tangential direction, in the area of the inner wall. For example, the angle of slope is chosen such that a sub-critical swirl degree is formed, wherein the swirl degree is particularly determined by the ratio of the velocity component in the tangential direction to the velocity component in the guiding direction and, for example, corresponds to it. As a consequence, a turbulence intensity is decreased. So, there is formed a sub-critical swirl (lower turbulence intensity), in particular up to a critical swirl degree, and a super-critical swirl (increased turbulence intensity) from the critical swirl degree upwards. The sub-critical swirl is particularly advantageous for the particle separation. The swirl degree particularly results from the ratio of the tangential to the axial impact flow.

In some aspects, the second pipe section, which is formed hollow-cylindrical, is fluid-technically arranged after the pipe section. For example, both pipe sections are coaxially arranged. For example, the second pipe section directly interfaces with the pipe section and the pipe section may directly transition into the second pipe section. In particular, the pipe section is formed at the second pipe section and therefore made of a piece, in particular monolithically, with it. For example, the second pipe section has a basically round cross-section. For example, at the side facing the pipe section, the second pipe section has the same inner diameter as the pipe section, avoiding a vortex of the dispersion or the fluid at the transition from the pipe section to the second pipe section. So, the second pipe section also has an inner wall and the dispersion or at least the fluid and the particles separated therefrom are also passed through the second pipe section in the guiding direction during operation, namely from the pipe section.

For example, the inner wall of the second pipe section also has a female thread at least sectionally, in particular completely, wherein, for example, the female thread of the pipe section directly transitions into the female thread of the second pipe section. In other words, the notch or, respectively, the notches of the female threads are aligned with each other. For example, the angle of slope of the female thread of the pipe section at the transition is the same as the angle of slope of the female thread of the second pipe section. Alternatively, or in combination with this, the inner wall of the second the pipe section is formed at least sectionally, in particular completely, smooth. A damming body is arranged in the second pipe section. In particular, it is arranged in the middle within the second pipe section, i.e. centrical within the second pipe section and, for example, on the axis of the second pipe section.

For example, the damming body is rotational symmetric or, in some aspects, rotational symmetric regarding the axis of the second pipe section. In particular, the damming body is flow-optimized. For example, the damming body is drop-shaped, wherein the larger end is particularly directed towards the pipe section. As such, the fluid-technical resistance of the damming body is decreased and turbulences are avoided. Guide blades extending radially outwardly are connected to the damming body, in particular are formed at it. In other words, the extension of the guide blades has at least one component in radial direction. The guide blades extend from the damming body to the inner wall of the second pipe section, i.e., at least sectionally radially and outwardly regarding the damming body. For example, the guide blades extend at least partially tangentially and may be formed spiral-shaped curved. The guide blades are formed spaced apart from the inner wall of the second pipe section.

Because of the distance of the guide blades to the inner wall, the part of the dispersion being radially at the outside is relatively slightly influenced by the guide blades. Because of the distance of the guide blades from the inner wall of the second pipe section, the rotational movement of the dispersion is maintained such that it still has the rotational movement after passing the damming body and the guide blades. In particular, the guide blades cause a maintenance of the swirl. The distance of the guide blades to the outer wall particularly has the effect that the absolute velocity of the swirl flow at the outer wall is still maximally maintained.

The dispersion is forced radially outwardly from the middle of the second pipe section by the damming body, wherein the rotational movement of the dispersion caused by the pipe section is maintained. As a consequence, the particles are forced outwardly and further accelerated towards the inner wall of the second pipe section because of the rotational movement. So, the increased centrifugal force and/or the fluid force act on the particles moved radially outwardly, wherefore particles being in the fluid after the pipe section are disposed towards the inner wall of the second pipe section. After passing the damming body, mostly, only the fluid is moved again into the middle of the second pipe section such that the outer areas of the dispersion still contain, mostly, only particles. To the contrary, the inner areas of the dispersion basically only have the fluid being moved inwardly after the damming body. So, an efficiency is increased by the damming body and the guide blades.

In some aspects, the guide blades are tilted regarding the guiding direction. In particular, the guide blades are tilted regarding the axis of the hollow-cylindrical second pipe section and therefore oblique to it. In some aspects, the guide blades form a male thread being connected to the damming body. Because of the tilt, the dispersion is further forced into the rotational movement by the guide blades during operation or at least the rotational movement of the dispersion is maintained.

In some aspects, the angle of tilt of the guide blades is the same as the angle of slope of the female thread. In other words, the guide blades have the same angle of slope as the female thread. As far as the angle of slope of the female thread is variable, in particular the angle of slope/tilt of the guide blades is the same as the angle of slope of the female thread at the transition from the pipe section to the second pipe section, as far as the second pipe section does not have any female thread. As far as the second pipe section also has the female thread, the angle of tilt of the guide blades may be the same as the angle of slope of the female thread of the second pipe section.

If the angle of slope of the female thread of the second pipe section is variable, in particular, the angle of tilt of the guide blades is also variable and may change in correspondence to the angle of slope of the female thread. Hereby, for example, the angle of tilt of the guide blades corresponds to the angle of slope of the female thread at the same position in axial direction and/or in the guiding direction. So, because of the tilt of the guide blades, the rotational movement caused by the female thread is increased or at least maintained. Consequently, the guide blades also contribute to the swirl generation or at least the swirl maintenance.

In some aspects, the length of the guide blades in the guiding direction is diminished with decreasing distance to the inner wall. In other words, the length of the guide blades overflowed by the dispersion decreases towards the inner wall. As a consequence, at the pipe wall, the dispersion basically maintains the original velocity, which dominates at the outlet of the pipe section, and the dispersion basically also still has the rotational movement corresponding to that of a solid body. As such, the separation of particles from the fluid is further enhanced. Alternatively, the cross-section of the guide blades has an overrun. In particular, the guide blades cross-section is spiral-shaped.

In some aspects, the damming body and/or the guide blades are formed of plastic. For example, the damming body and the guide blades are formed of a piece (monolithically). For example, between 3 guide blades or 20 guide blades and, for example, 4 guide blades or 8 guide blades are connected to the damming body. So, the flow resistance is relatively low, wherein an efficient maintenance or implementation of the rotational movement in the dispersion nevertheless is given.

In some aspects, the second pipe section is widened at a side facing away from the pipe section. For example, the inner diameter of the second pipe section continuously increases or the inner diameter at least continuously increases starting at a given point of the second pipe section. Alternatively, for example, a step or similar is present. Because of the widening, particles are further removed from the middle of the second pipe section such that a backflow of these after the damming body towards the middle of the second pipe section is further prevented. Additionally, in this way, a disposing of the particles is simplified. Because of the widening, in particular, the area of the cross-section of the gap surrounding the flow body increases continuously/exponentially. In this way, flow conditions are generated which prevent a backflow/back effect of the particles. So, particles in a secondary volume flow particularly do not reach the primary volume flow.

For example, a hollow-cylindric pipe section is arranged fluid-technically before the pipe section, for example, directly before the pipe section. In other words, in particular, the third pipe section transitions into the pipe section and, for example, the pipe sections are formed at each other, in particular made of a piece, for example monolithically. In some aspects, the axis of the hollow-cylindrical pipe sections are parallel to each other, and may be the same. In some aspects, the third pipe section is arranged coaxially to the pipe section, and/or the pipe section has the same inner diameter as the third pipe section. For example, the cross-section of the third pipe section is round. Another damming body is arranged in the third pipe section, for example, centrically. For example, the damming body is arranged in the middle of the axis of the hollow-cylindrical third pipe section and, may be formed rotation or rotational symmetric regarding it.

Guide blades extending radially outwardly are arranged at the further damming body. In other words, the further guide blades extend from the further damming body at least partly radially outwardly. The guide blades are connected to an inner wall of the third pipe section. So, basically every part of the dispersion is influenced regarding its movement by the guide blades, wherein the dispersion is forced radially outwardly by the damming body. In other words, the further guide blades contribute to guide the dispersion. For example, between two further guide blades and 20 further guide blades and, for example, 10 further guide blades are present. Alternatively, the damming body is omitted and the further guide blades are formed at each other. A pre-swirl is provided by the further guide blades, wherefore particularly the pipe section may be formed shortened. In this case, the pipe section contributes to the "homogenization/easing" of the swirl flow. In particular, hereby, the length of the pipe section is at least the same as 10 times the (inner-) diameter of the pipe section.

In some aspects, the further guide blades are tilted at least sectionally regarding the guiding direction. In other words, the further guide blades include an angle of tilt regarding the guiding direction or at least regarding the axis of the third pipe section. Hereby, the angle of tilt may be constant. In some aspects, the angle of tilt is not constant and so the guide blades are curved. Because of the tilt of the guide blades, before entering the pipe section, the dispersion already is forced into a swirl movement, i.e., rotational movement around the axis of the third pipe section. In other words, when entering the pipe section, the dispersion already partly rotates. Possible turbulences within the dispersion are diminished and its moving image, in particular a velocity profile of the dispersion, is homogenized by the female thread of the pipe section, such that the dispersion basically has the velocity profile of a rotating solid body when leaving the pipe section. In other words, the velocity component in tangential direction increases with increasing radial distance to the middle axis of the pipe section, in particular, linearly. As far as the second pipe section is present, the angle of slope of the female thread at the side facing the third pipe section is different from 0° and, in particular, corresponds to the angle of tilt of the guide blades regarding the guiding direction at the side facing the pipe section. Consequently, in particular, this swirl flow is eased.

In some aspects, a separation chamber is arranged fluid-technically after the pipe section. As far as the second pipe section is present, hereby the separation chamber is arranged fluid-technically after the second pipe section, in particular directly. As far as the second pipe section is not present, for example, the separation device is arranged directly after the pipe section. The separation chamber itself has a separation pipe (for example, a dip tube), which, in particular, is arranged coaxial to the pipe section, and may be coaxial to the second pipe section, as far as it is present. For example, the separation pipe (immersion pipe) itself has a basically round cross-section perpendicular to the guiding direction. For example, the separation pipe is orientated basically parallel to the guiding direction. The inner diameter of the separation pipe is smaller than the inner diameter of the pipe section. Regarding the circumference, the separation pipe is surrounded by a collecting chamber. Hereby, the particles are moved into the collecting chamber (secondary volume flow) by the movement of the particles towards the inner wall of the pipe section, whereas the fluid enters the separation pipe (primary volume flow). So, the fluid cleaned regarding the particles and the particles are provided by the separation chamber, wherein basically only relatively low traces of the fluid are present in the latter.

In some aspects, the collecting chamber directly surrounds the separation pipe, which, for example, has a relative thin wall. So, it is possible, to select the degree of purity of the fluid or the degree of purity of the separated particles by the selection of the inner diameter of the separation pipe. For example, the separation pipe at least partly is closed by a cone or similar at the side facing away from the pipe section, wherein, in particular, a circumferential slit is formed between the rim of the separation pipe and the cone. The fluid exits through the slit during operation. In some aspects, the top of the cone protrudes into the separation pipe and, for example, the cone is arranged coaxially regarding the separation pipe. In particular, the cone acts as a ram pressure body and/or for regulating the pressure conditions/velocity conditions at the inlet of the separation pipe. Alternatively, for example, the separation pipe has a terminal for a conduit. For example, the inner diameter of the separation pipe is widened at the side facing away from the pipe section. For example, the inner diameter increases from the beginning of the separation pipe at the side of the pipe section in the guiding direction. Consequently, a velocity of the fluid is diminished during operation.

A uniflow cyclone separator having a hollow-cylindric pipe section for leading a dispersion in a guiding direction, wherein an inner wall of the pipe section has a female thread, is used for the separation of particles from the dispersion, which contains the particles and an incompressible fluid, such as a liquid. In other words, the dispersion is a suspension. In particular, the dispersion is composed of the particles and the incompressible fluid, wherein, for example, the fluid is a mixture of different liquids. For example, the fluid is water or contains it. For example, the particles are homogeneous or, in some aspects, heterogeneous and have a grain size of more than 1 μm, more than 0.1 mm or more than 1 mm. For example, the uniflow cyclone separator is used in an industrial facility, in particular for providing cooling water. Alternatively, the uniflow cyclone separator may be used in mining, in particular for providing processing water. Alternatively, the uniflow cyclone separator is used for pre-cleaning in a desalination facility by which, in particular, seawater is desalinated.

The aspects and advantages explained regarding the uniflow cyclone separator analogously are transferred to its use and vice versa.

In FIG. 1 a uniflow cyclone separator 4 is schematically simplified shown in a cut along a longitudinal axis 2. The uniflow cyclone separator 4 is used to filter the dispersion 6, which is composed of an incompressible fluid 8 in the form of water and particles 10 in the form of sand, and as such to separate the particles 10 from the dispersion 6 such that the incompressible fluid 8 is present basically pure. Thus, the dispersion 6 is the suspension. The uniflow cyclone separator 4 may be arranged before a seawater desalination facility and the dispersion 6 is taken out of the sea such that the fluid 8 is seawater. Hereby, particles 10 being present in the seawater would damage the seawater desalination facility or at least lower its efficiency. Therefore, it is necessary that the particles 10, i.e. the sand, as well as further solid parts being present in the seawater are removed from the seawater.

The uniflow cyclone separator 4 has a hollow-cylindrical pipe section 12 and a second pipe section 14 being fluid-technically arranged afterwards and being formed hollow-cylindric. The second pipe section 14 is formed at the pipe section 12 and coaxially arranged regarding the pipe section 12. The inner diameter of the pipe section 12 is constant and the same as the inner diameter of the second pipe section 14 at the side facing the pipe section 12. At the side facing away from the pipe section the second pipe section 14 is widened such that the inner diameter increases.

Fluid-technically after the second pipe section 14 a separation chamber 16 is arranged, which therefore is fluid-technically arranged after the pipe section 12 also. The separation chamber 16 has a collecting chamber 18 having a guiding pipe 20, which is formed at the second the pipe section 14 at the side facing away from the pipe section 12. The second pipe section 14 is widened with a continuous distance to the pipe section 12 and the guiding pipe 20 is widened with increasing distance to the pipe section 12 also. Hereby, the inner diameter of the guiding pipe 20 on the side facing the second pipe section 14 is the same as the inner diameter of the second pipe section 14. The guiding pipe 20 is also coaxially arranged regarding the second pipe section 14, i.e. regarding the longitudinal axis 2, such that a relative smooth transition between these is present.

A separation pipe 22 is coaxially arranged within the guiding pipe 20 and is therefore also coaxially regarding the pipe section 12 and the second pipe section 14, the inner diameter of the guiding pipe 20 being smaller than the diameter of the pipe section 12 at the side of the pipe section 12 as well as of the first the pipe section 14 and is therefore also smaller than the inner diameter of the second pipe section 14. The inner diameter of the separation pipe 22 is widened with increasing distance to the pipe section 12, wherein the length of the separation pipe 22, over which it is widened, corresponds to the length of the guiding pipe 20. In other words, the separation pipe 22 is widened in that area, in which it is arranged in the guiding pipe 20. So, a circumferential slot 24 is formed between the guiding pipe 20 and the separation pipe 22, the slot 24 having a cross section, which continuously/exponentially increases in direction away from the pipe section 12. The length of the separation pipe 22 is larger than the length of the guiding pipe 20, and a separation wall 26 is attached to the guiding pipe 20 with a distance to the guiding pipe 20, in particular formed at it, limiting the collecting chamber 18. So, the separation pipe 22 is at least sectionally surrounded by the collecting chamber 18. A cone-shaped ram pressure body 28 protrudes with its tip into the separation pipe 22 from the side facing away from the pipe section 12, which is formed coaxial regarding the longitudinal axis 2 also. Hereby, a circumferential slit 30 is formed between the ram pressure body 28 and the separation pipe 22.

The hollow-cylindrical pipe section 12 has an inner wall 32, which forms the limitation of the pipe section 32 in radially direction. The area within the inner wall 32 is free from further parts of the uniflow cyclone separator 4 such that during operation the pipe section 12 can be flowed basically free by the dispersion 6 in the guiding direction 34, which is parallel to the longitudinal axis 2 and directed from the pipe section 12 towards the separation chamber 16. The inner wall 32 has a female thread 36 with 12 notches 38. For example, the length of the pipe section 12 in the guiding direction 34 is 6.5 m.

Figure 2:
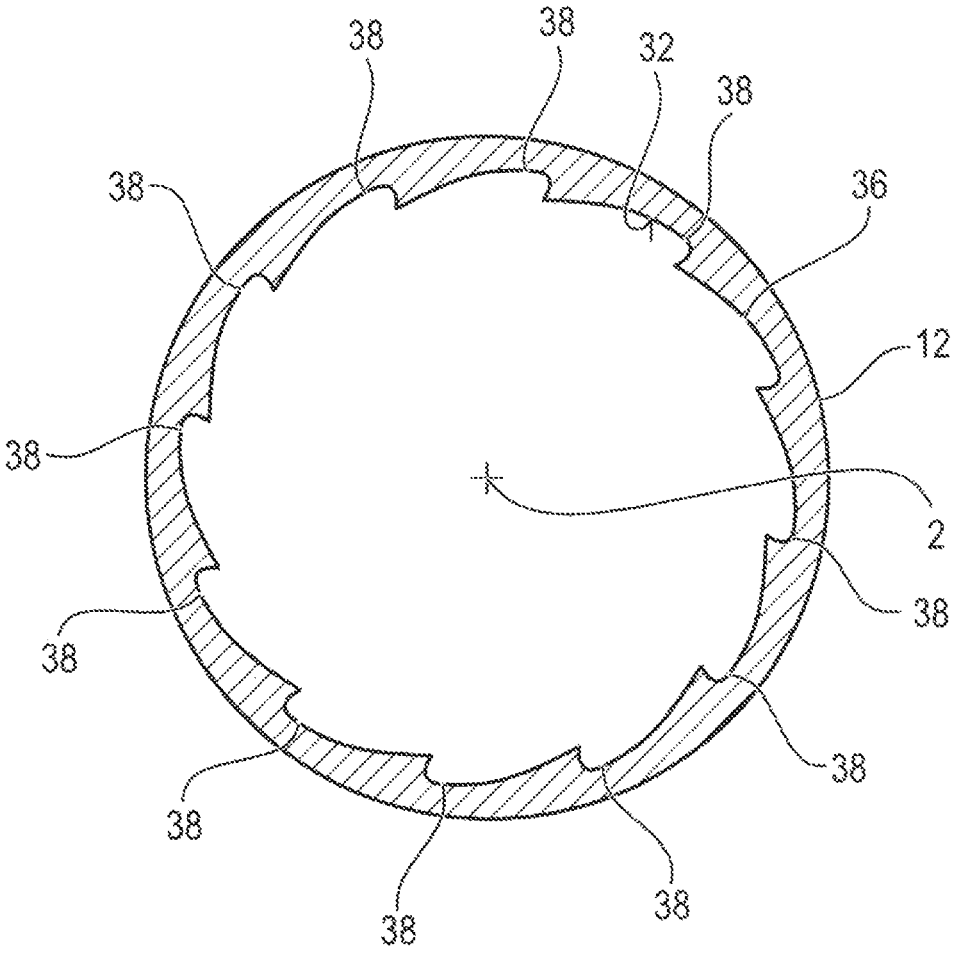
FIG. 2 shows a cross-section of the pipe section.

In FIG. 2, a cross-section of the pipe section 12 perpendicular to the longitudinal direction 2 is shown. The notches 38 are rounded and are formed in the manner of handles or ears such that a circular saw blade-shaped cross-section of the pipe section 12 is given. An angle of slope 40 is formed between each of the notches 38 and the guiding direction 34, wherein all angles of slope 40 of the notches 38 are the same at each cross-section perpendicular to the guiding direction 2. In other words, the notches 38 extend in constant tangential distance and consequently parallel to each other. The angle of slope 40 increases in the guiding direction 34. So, in guiding direction the notches 38 have an angle of 15° at the beginning of the pipe section 12. Whereas, at the transition of the pipe section to the second pipe section 14 the inner thread 36 and thus all notches 38 have an angle of slope of 45°. The increase of the angle of slope 40 is linear or exponential. Consequently, the extension of the notches 38 is in the manner of a helix around the longitudinal axis 2, wherein the distance of the helix winding (coil) and the guiding direction 34 decreases because of the increase of the angle of slope. In other words, it is about a clinched helix.

Figure 3:
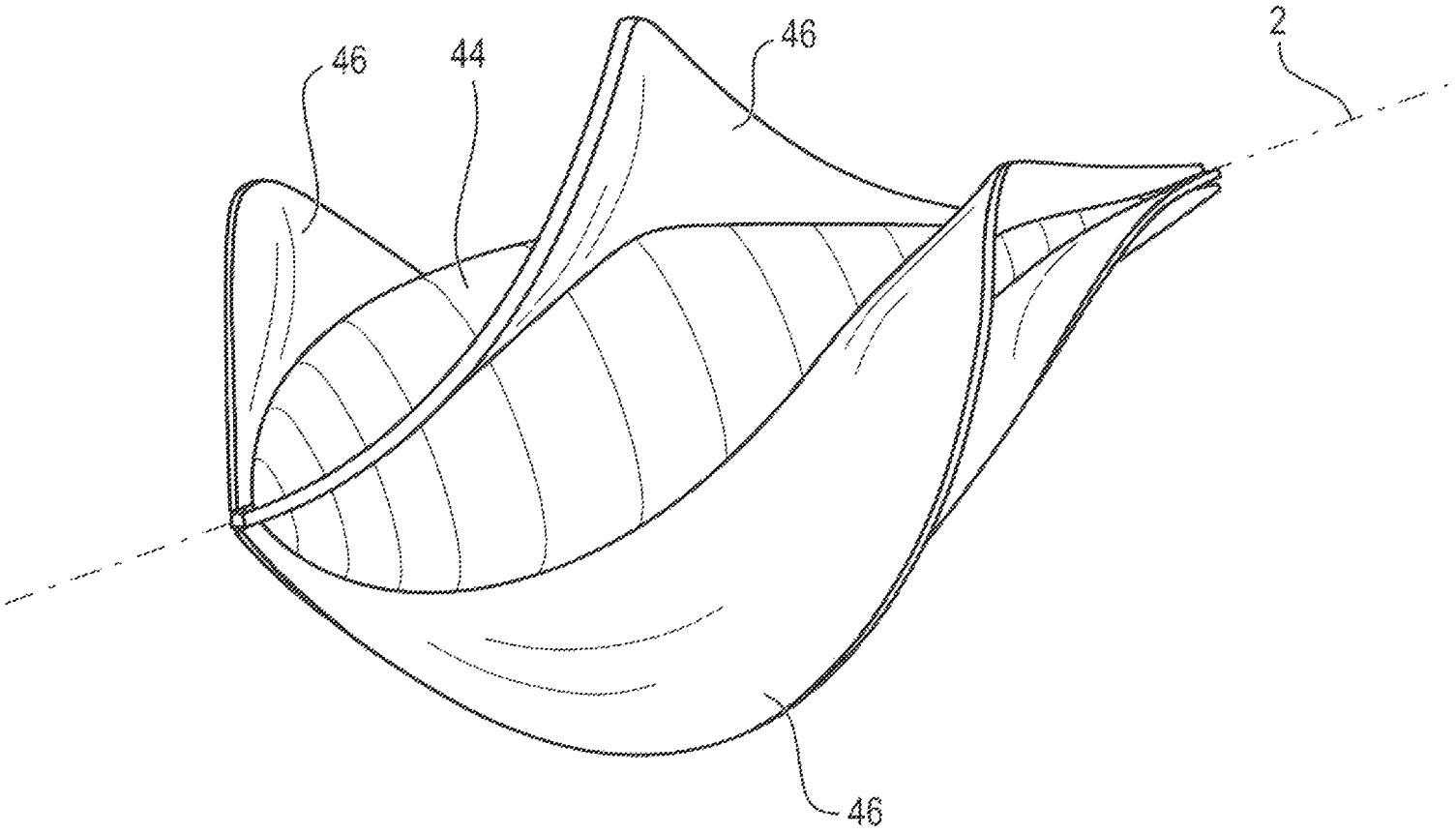
FIG. 3 shows a perspective view of the damming body with guide blades being attached to it and extending radially outwardly, FIG. 4 schematically shows an aspect of the uniflow cyclone separator.

The second pipe section has an inner wall 41 with a female thread 42 also, which has 12 notches also. The notches 38 of the thread 36 of the pipe section 12 directly transitions into the notches of the female thread 42 of the second pipe section 14 and align with it. The angle of slope 40 of the thread 42 of the second pipe section 14 is constant and is 45°. Within the second pipe section 14 the damming body 44, shown in a perspective view in FIG. 3, is arranged, which is drop-shaped and formed of plastic. Hereby, the thickened end faces the pipe section 12 and the tapered end faces towards the separation chamber 16. Alternatively, the damming body 44 has a lens-shaped contour sharply terminating towards the separation chamber 16. In other words, the damming body 44 has a rotational symmetric shape of the upper wing contour. The rotational symmetric damming body 44 is centrally arranged within the second pipe section 14 and thus rotational symmetric regarding the longitudinal axis 2. The maximal extension of the damming body 44 in radially direction, i.e., perpendicular to the longitudinal axis 2, is basically half the diameter of the pipe section 12. In particular, the maximal extension depends of the flow velocity and the particles to separate.

Eight guide blades 46, of which only four are shown, extend radially outwardly and are attached at the damming body 44. The guide blades 46 are spaced apart from the inner wall 41 of the second pipe section 14 and tilted regarding the guiding direction 34 such that they are wounded around the damming body and thus form a male thread. The angle of slope (angle of tilt) of the guide blades 46 regarding the guiding direction 34 is the same as the angle of slope 40 of the female thread 36 at the transition to the second thread 42 and the same as the angle of slope of the female thread 42 of the second pipe section 41 and is consequently 45°. The length of the guide blades 46, i.e., their extension in the guiding direction 34, is decreased with increasing distance to the longitudinal axis 2. So, the guide blades 46 basically are drop-shaped also, seen from a lateral top view. Hereby, the guide blades 46 extend radially (just lying on the radius) in the cross-section (pipe cross-section). Alternatively, the cross-section of the guide blades 46 has an overrun. That is, the cross-section of the guide blades follows the spiral-shaped contour.

During operation, the dispersion 6 is passed into the pipe section 12 in the guiding direction 34 through an inlet 48, which is arranged at the side facing away from the second pipe section 14. Hereby, the dispersion 6 basically has only a velocity component in the guiding direction 34. Because of the female thread 36, the dispersion is forced into a rotational movement around the longitudinal axis 2 in the area of the inner wall 32. This velocity component is transferred to areas of the dispersion 6, which are spaced apart from the inner wall 32, because of the viscosity of the dispersion 6. Consequently, the velocity component of the dispersion 6 perpendicular to the guiding direction 34 is larger the further the dispersion 6 is at the inner wall 32. The absolute value of the velocity is proportional to the distance to the longitudinal axis 2, wherefore the dispersion 6 has a rotational movement also, which is directed around the longitudinal axis 2, in addition to the translational movement.

In other words, the rotational axis of the dispersion is the same as the longitudinal axis 2. Consequently, the dispersion 6 behaves like a solid body, at which a velocity component in tangential direction linearly increases with the distance to the rotational axis during the rotational movement. Because of the increase of the angle of slope 40, the rotational velocity of the dispersion 6 increases with increasing penetration of the pipe section 12. The particles 10 are moved radially outwardly by the centrifugal force (volume force) caused by the rotation and by the buoyancy (fluid force directed towards the inner wall 32 and caused by the velocity gradient).

Subsequently, the dispersion 10 comes upon the damming body 44 after passing the pipe section 12 such that the complete dispersion is moved radially outwardly in radial direction. Hereby, the rotational movement of the dispersion 6 is maintained by the female thread 42 of the second pipe section 14 as well as the guide blades 46. After passing the radial farthest extension of the damming body 44, the fluid 8 only is moved towards the longitudinal axis 2 again, because of the rotational movement, whereas the particles 10 stay radially outwardly. Therefore, the particles 10 have a larger distance to the longitudinal axis 2 than the opening of the separation pipe 22, wherefore the particles 10 reach into the slot 24 and so into the collecting chamber 18. There, they come upon the separation wall 26 and thus are prevented from a further movement in the guiding direction 34. Contrarily, regarding the inner wall 41 of the second pipe section 14, the fluid 8 is shifted inwardly towards the longitudinal axis 2 and passes into the separation pipe 22. There, it comes upon the ram pressure body 18 and is channeled through the slit 30 out of the uniflow cyclone separator 4. By selecting the inner diameter of the separation pipe 22 on the side of the second pipe section 14, it is possible to set the purity of the fluid 8 and, respectively, the particles 10.

Figure 4:
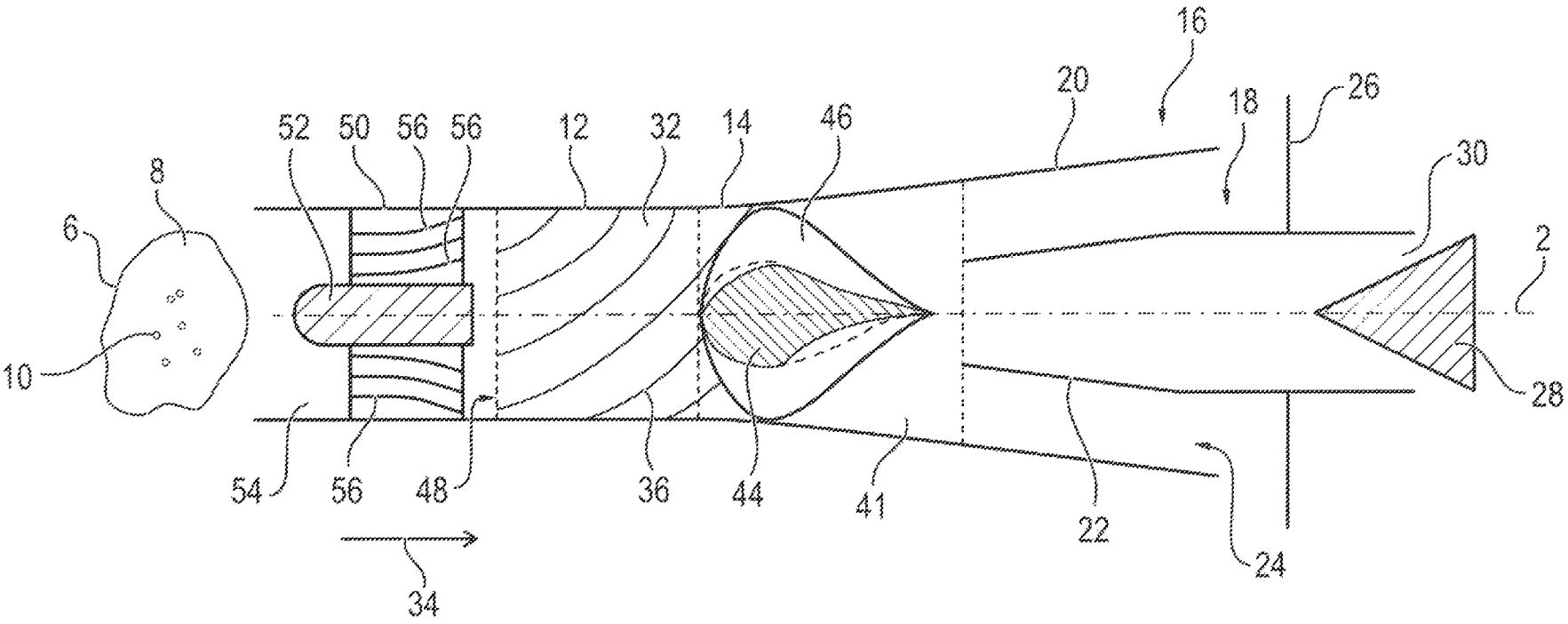

In FIG. 4, a modification of the uniflow cyclone separator 4 is shown. Hereby, the hollow-cylindrical third pipe section 50 is arranged fluid-technically before the inlet 48. However, a further modification is not present such that the pipe section 12, the second pipe section 14, the separation chamber 16, the damming body 44, as well as the guide blades 46 are left unchanged. Alternatively, the length of the pipe section 12 is shortened. The third pipe section 14 has the same inner diameter as the pipe section 12 and is concentrically arranged with respect to it. Further, the third pipe section 50 is attached to the pipe section 12 and therefore made of a piece, i.e. monolithically, with it. Another damming body 52 is arranged within the third pipe section 50, which is cylindrically formed or flow-optimized and concentrically arranged regarding the longitudinal axis 2. The other damming body 52 is dome-shaped at the side facing away from the pipe section 12. In sum, the damming body 52 is in the middle of the third pipe section 50, wherein the other damming body 52 is spaced apart from an inner wall 54 of the third pipe section.

Further guide blades 56 extending radially outwardly are attached at the other damming body 52. Hereby, ten further guide blades 56 are present. The further guide blades 56 extend radially and are attached at the other damming body 52 as well as the inner wall 54 of the third pipe section 50 and are formed at it. Additionally, the further guide blades 56 are sectionally tilted regarding the guiding direction 34, i.e. regarding the longitudinal axis 2, and rounded. Consequently, during operation, the dispersion 6 is passed into the third pipe section 50 at the side facing away from the pipe section 12 and already is forced into the rotational movement regarding the longitudinal axis 2 by the further guide blades 56. Hereby, the dispersion 6 is forced between the damming body 52 as well as the inner wall 54 of the third pipe section 50 and past the further guide blades 56. Because of the curvature of the further guide blades 56, the rotational velocity of the dispersion 6 increases with increasing passage in the guiding direction 34. Alternatively, the further damming body 52 is omitted, and the further guide blades 56 are attached at each other in the middle of the third pipe section 50.

Because of the friction of the dispersion 6 at the guide blades 56 of the inner wall 54 of the third pipe section 50 as well as at the possibly present damming body 50, the parts of the dispersion being radially outwardly have a decreased velocity. So, in particular, the velocity profile of the dispersion 6 after passing the damming body 52 as well as the further guide blades 56 is such that the maximal velocity of the dispersion is basically in the middle between the inner wall 54 of the third pipe section 50 and the longitudinal axis 2. The dispersion 6 being forced into rotation in this manner is passed into the pipe section 12. Here, a change of the velocity profile is caused by the female thread 36 of the pipe section 12 such that the (absolute) velocity of the dispersion 6 is increased with increasing distance to the longitudinal axis 2. Consequently, the dispersion 6 has a velocity profile like a rotating solid body when leaving the pipe section 12. In other words, the rotational velocity of the dispersion 6 increases with increasing distance to the longitudinal axis 2. Here as well, the separation of the particles 10 from the incompressible fluid 8 is caused by the rotational movement, which is implemented into the dispersion 6 by the further guide blades 56 as well as the by the thread 36. Therefore, after passing the second pipe section 14, the particles 10 are basically completely discharged through the slot 24 and the fluid 8 through the slit 30 from the uniflow cyclone separator.

The swirl generation of the dispersion 6 is caused by the pipe section 12, which is formed in the manner of the swirl pipe. In other words, the dispersion 6 is forced into a rotational movement. So, the dispersion 6 is forced into the rotational movement by a pressure impact input, which is caused by the notches 38, which have the angle of slope 40 regarding the longitudinal axis 2. Further, as an alternative, the notches are not rounded, but, for example, angular-shaped. However, the pipe section 12 at least has the female thread 32, having several notches 38. For example, the thread slope, i.e. the angle of slope 40 of the female thread 36, increases continuously from 5° to 45°.

As far as the further guide blades 56 are present, a smoothening of the rotational movement of the dispersion 6 is achieved by the female thread 36, wherefore the length of the pipe section 12, i.e., its extension in guiding direction 34, may be decreased. A swirl structure is induced into the dispersion 6 by the thread 36, which corresponds to a pure rigid body rotation (solid body rotation). In other words, the tangential velocity profile, in particular from the pipe middle axis, i.e., from the longitudinal axis 2, linearly increases radially outwardly. Consequently, the maximal absolute velocity of the dispersion 6 basically is present at the inner wall 32 of the pipe section 12 as well as at the inner wall 41 of the second pipe section 414. Consequently, the particles 10 are exhibited to a point-symmetrical centrifugal force outwardly acting from the pipe middle axis, i.e., the longitudinal axis. In other words, the particles 10 are moved radially outwardly, whereas the fluid 8 stays in the middle of the pipe sections because of the lowered density and the acting forces.

The particles 10 are also entrained by faster parts of the flow of the dispersion 6. The particles 10 are relative efficiently moved radially outwardly, because the relative faster parts of the flow are shifted to the inner wall 32 of the pipe section 12 as well as to the inner wall 41 of the second pipe section 14. For enhancing the movement of the particles 10 from the area of the pipe middle axis, i.e., from the area of the longitudinal axis 2, towards the inner wall 41 of the second pipe section 14, the damming body 44 is arranged within the second pipe section 14 and fluid-technically before the separation chamber 16. In particular, the damming body 44 is flow-optimized. In this manner, areas of detachment and, as a consequence thereof, in particular, turbulences in the overrun are avoided.

The guide blades 56 may have the same slope as the female thread 36 and/or the female thread 42 of the second pipe section 14, as far as it is present. Hereby, the overflow of the length of the guide blades 46 decreases towards the inner wall 41 of the second pipe section 14 and may be relatively small at that the inner wall 41. Consequently, the swirl flow of the dispersion 6 maintains its maximal velocity in the area of the inner wall 41 of the second pipe section 14. In other words, the dispersion 6 has the largest velocity in tangential direction and/or in guiding direction 34 in the area of the inner wall 41 of the second pipe section 14. So, the structure of the rigid body rotation of the dispersion 6 is also maintained after the passage and during passage of the second pipe section 14. Therefore, the particles 10 present in the dispersion 6 are forced outwardly, into an area with a relative fast flow, in particular a relative high velocity in tangential direction, and, in particular, are carried by it, because of the geometry of the damming body 44. Consequently, the particles 10 do not reach the middle of the pipe and thus not the longitudinal axis 2 again, after passing the damming body 46.

The separation of the particles to 10 is achieved by the separation chamber 14. Hereby, the geometric design of the separation pipe 22 as well as of the guide pipe 10 and the slot 24 formed therebetween is determinative for the selectivity, i.e., the percentage of the separated particles 10, as well as for the efficiency, i.e., the ratio of the fluid 8 guided out of the uniflow cyclone separator 4 to the volume of the dispersion 6 passed into the uniflow cyclone separator. The rotation of the dispersion is 6 is flow-mechanically optimized by the female thread 36. An optimal separation of the particles 10 is achieved by the damming body 44 in conjunction with the female thread 36.

The uniflow cyclone separator 4 conduces to the separation of the particles 10 from a compressible or incompressible fluid 8. Hereby, the dispersion 6 is forced into the rotation by the pipe section 12 formed as a swirl pipe. For a more efficient generation of the rotation, the inner wall 32 has the female thread 36 with several notches 38, which ideally have the increasing angle of slope 40 in the guiding direction 34, which corresponds to the flow direction of the dispersion 6. The swirl structure of the dispersion 6 generated in this manner is similar to the pure rigid body rotation (solid body rotation) with a radially outwardly and linearly increasing velocity profile in tangential direction. After passing the pipe section 12, the rotating dispersion 6 is guided around the damming body 44, which is arranged in the middle of the second the pipe section 14 and before the separation chamber 16. Because of the damming body 44, the amount of particles 10, which are present in an area around the pipe middle axis, i.e. in the area around the longitudinal axis 2, after passing the second pipe section 14, is decreased and the particles the 10 are shifted towards the inner wall 41 of the second pipe section 14. The damming body 44 and the guide blades 46 are flow-optimized and formed such that the swirl flow still has its maximal velocity at the inner wall of 41 of the second pipe section 14, wherefore the particles 10 being present in the dispersion 6 are forced radially outwardly. These are separated from the fluid 8 by the separation chamber 16.

In further other words, the disclosure refers to a uniflow cyclone separator 4, also referred to as unidirectional particle cyclone separator or axial particle cyclone separator (centrifugal separator). This is particularly meant and appropriate for separating particles 10 from a dispersion 6, wherein the dispersion 6 has the incompressible fluid 8 and may be composed of the incompressible fluid 8 as well as of the particles 10. The uniflow cyclone separator 4 has the pipe section 12 with the female thread 36. In other words, the pipe section 12 has an inner wall being at least sectionally similar to a thread, wherein the female thread 36 conduces to the swirl generation, i.e., the forcing of the dispersion 6 in the rotational movement in addition to the translational movement along the longitudinal direction 34. The thread slope, i.e., the angle of slope 40 of the female thread 36, increases along the guiding direction 34, i.e., along the flow direction.

In some aspects, the uniflow cyclone separator 4 has the second pipe section 14, in the center of which the flow-optimized damming body 44 is arranged, to which the thread-shaped guide blades 46 are attached. The slope of the thread-shaped guide blades 46 corresponds to the largest thread slope, i.e., the largest angle of slope 40 of the female thread 36. Additionally, the overflowed length of the guide blades 46 decreases towards the inner wall 41 of the second pipe section 14.

Further, the second pipe section 14 is provided at the side facing away from the pipe section 12. In other words, the inner diameter is enlarged. Additionally, the uniflow cyclone separator 4 has the separation chamber 16 with the separation pipe 22, which is introduced into the guide pipe 20 in counter-flow direction, i.e. contrary to the guiding direction 34. The ram pressure body 28 is introduced into the separation pipe 22 at the downstream arranged end, wherein the slit 30 is formed between those. The downstream positioned end of the separation pipe 22 is that end of the separation pipe 22 facing away from the pipe section 12. The separation pipe 22 is arranged coaxially to the pipe section 12, the second pipe section 14, as well as to the guide pipe 20, and the inner diameter as well as the outer diameter of the separation pipe 22 is diminished and as such tapered in counter-flow direction, i.e., on the side of the second pipe section 14.

Figure 5:
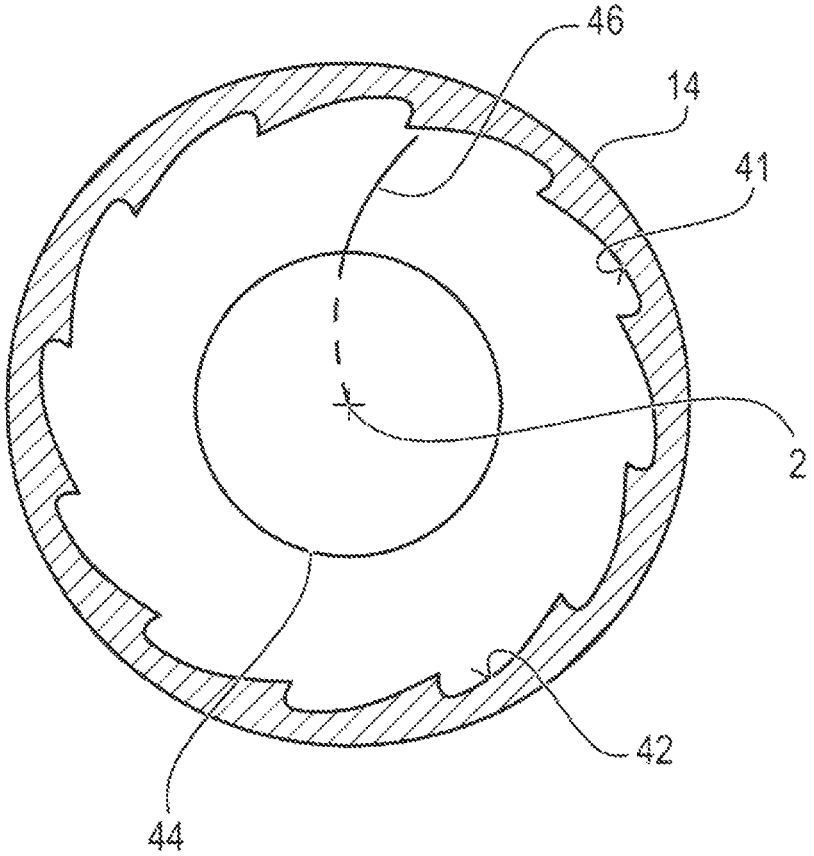
FIG. 5 shows a cross-section of an aspect of the second pipe section and a damming body having guide blades being attached to it.

In FIG. 5, an aspect of the second pipe section 14 is shown as a cross-section. Hereby, basically the guide blades 46 are changed. Eight guide blades 46 are rotational symmetrically arranged at the damming body 44, of which only a single one is shown, and are spiral-shaped. So, the guide blades 46 additionally have an extension in tangential direction. Further, the guide blades 46 have an overrun regarding the swirl.

The disclosure is not limited by the aspects described above. Rather other variants of the disclosure may be deduced herefrom, without departing from the subject of the disclosure. In particular, further, all single features described in conjunction with the single aspects are combinable with each other in another way, without departing from the subject of the disclosure.

The invention claimed is:

1. A uniflow cyclone separator for separating particles from a dispersion comprising the particles and a fluid, the uniflow cyclone separator comprising:

a hollow-cylindrical pipe section for guiding the dispersion in a guiding direction, wherein an inner wall of the hollow-cylindrical pipe section comprises a female thread having an angle of slope increasing in the guiding direction, and wherein the female thread forms a helix along the guiding direction.

2. The uniflow cyclone separator in accordance with claim 1, wherein the female thread comprises a plurality of notches between 4 notches and 20 notches.

3. The uniflow cyclone separator in accordance with claim 1, wherein the angle of slope increases in the guiding direction from a minimum angle of slope that is at least 15° to a maximum angle of slope that is no more than 60°.

4. The uniflow cyclone separator in accordance with claim 1, further comprising a hollow-cylindrical second pipe section arranged after the hollow-cylindrical pipe section in the guiding direction, wherein a damming body with guide blades extending radially outwards is attached to and arranged in the hollow-cylindrical second pipe section, and wherein the guide blades are spaced apart from an inner wall of the hollow-cylindrical second pipe section.

5. The uniflow cyclone separator in accordance with claim 4, wherein the guide blades are tilted with respect to regarding the guiding direction and comprise the same angle of slope as the female thread.

6. The uniflow cyclone separator in accordance with claim 4, wherein a length of the guide blades in the guiding direction diminishes with increasing distance to the inner wall.

7. The uniflow cyclone separator in accordance with claim 4, wherein the hollow-cylindrical second pipe section is widened at the side facing away from the hollow-cylindrical pipe section.

8. The uniflow cyclone separator in accordance with claim 1, further comprising a hollow-cylindrical third pipe section further comprising a hollow-cylindrical third pipe section arranged before the hollow-cylindrical pipe section in the guiding direction, wherein a further damming body having further guide blades extending radially outwards is attached to and arranged in the hollow-cylindrical third pipe section, and wherein the further guide blades are attached to an inner wall of the hollow-cylindrical third pipe section.

9. The uniflow cyclone separator in accordance with claim 8, wherein the further guide blades are at least sectionally tilted with respect to the guiding direction.

10. The uniflow cyclone separator in accordance with claim 1, further comprising a separation chamber arranged after the hollow-cylindrical pipe section in the guiding direction, the separation chamber comprising a separation pipe being arranged coaxially to the hollow-cylindrical pipe section, the separation pipe having an inner diameter which is smaller than the inner diameter of the hollow-cylindrical pipe section and circumferentially being surrounded by a collecting chamber.

* * * * *